US006286614B1

(12) United States Patent
Gano et al.

(10) Patent No.: US 6,286,614 B1
(45) Date of Patent: Sep. 11, 2001

(54) MOTION COMPENSATOR FOR DRILLING FROM A FLOATER

(75) Inventors: John C. Gano, Carrollton; John S. Bowling, Dallas, both of TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/536,508

(22) Filed: Mar. 27, 2000

(51) Int. Cl.[7] ..... E21B 17/10
(52) U.S. Cl. ..... 175/274; 175/279; 166/381
(58) Field of Search ..... 175/274, 279, 175/281, 284, 290, 291, 51, 81; 166/381, 382, 117.7

(56) References Cited

U.S. PATENT DOCUMENTS 3,747,674 * 7/1973 Murray ..... 166/98
4,842,082 * 6/1989 Springer ..... 175/279
5,363,931 * 11/1994 Moriarty ..... 175/325.5
5,697,449 * 12/1997 Hennig et al. ..... 166/382
B1 4,270,606 * 1/1986 McStravick et al. ..... 166/181

OTHER PUBLICATIONS

SKF Planetary Roller Screw Catalog, Three Pages, undated.

* cited by examiner

*Primary Examiner*—Frank S. Tsay
(74) *Attorney, Agent, or Firm*—Paul I. Herman; Marlin R. Smith

(57) ABSTRACT

A motion compensator for drilling from a floater provides isolation of a cutting device in a well from motion of a tubular string thereabove. In a described embodiment, a motion compensator includes an anchoring device and an axial advancement device. The motion compensator is positioned in the tubular string above the cutting device. The anchoring device anchors the motion compensator in the well, while the advancement device axially advances the cutting device.

38 Claims, 8 Drawing Sheets

MOTION COMPENSATOR FOR DRILLING FROM A FLOATER

BACKGROUND OF THE INVENTION

The present invention relates generally to drilling, milling and similar operations performed in conjunction with a subterranean well and, in an embodiment described herein, more particularly provides a motion compensator for drilling from a floater.

It is frequently desirable to isolate a cutting device, such as a drill bit or a mill, from the motion of a tubular string on which the cutting device is carried. For example, where a cutting operation is being performed from a floating rig (sometimes referred to as a "floater"), the tubular string suspended from the floater may rise and fall due to a heaving motion of the rig. Some floaters may be equipped with devices known as heave motion compensators, but these devices are not typically capable of removing all rising and falling motion from a suspended tubular string.

In some circumstances, accurate axial advancement of the cutting device in the well may be required. This accurate advancement is compromised by the rising and falling of the tubular string. For example, the cutting device may be a mill which may be damaged if the mill suddenly impacts a structure downhole. Of course, many other circumstances also require accurate axial advancement of a cutting device, whether the operations are performed from a floater or a landbased rig.

From the foregoing, it can be seen that it would be quite desirable to provide a motion compensator which permits accurate axial advancement of a cutting device. It is accordingly an object of the present invention to provide such a motion compensator and associated methods of controlling displacement of a cutting device in a well.

SUMMARY OF THE INVENTION

In carrying out the principles of the present invention, in accordance with an embodiment thereof, a motion compensator is provided which includes an anchoring device and an axial advancement device. Associated methods are also provided.

In one aspect of the present invention, the anchoring device includes a slip and a shoulder engageable with an abutment in the well. The engagement between the shoulder and the abutment axially positions the motion compensator in the well. The slip extends outwardly from the motion compensator to grip a structure in the well and thereby prevent rotation of the motion compensator.

In another aspect of the present invention, the anchoring device includes a key member which is outwardly extendable to engage a recess in the well, thereby axially and rotationally anchoring the motion compensator in the well. The motion compensator may be provided with a diameter sensing device so that, when the device senses a predetermined diameter in the well, the key member is extended outwardly.

In yet another aspect of the present invention, the advancement device includes a restroking or recocking mechanism. The mechanism permits the cutting device to be withdrawn from the structure being cut, for example, if the cutting device stalls, etc., and then again advanced in a controlled manner toward the structure to be cut. In one embodiment, the mechanism includes ratcheting members, and in another embodiment, the mechanism includes a telescoping outer housing of the motion compensator.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
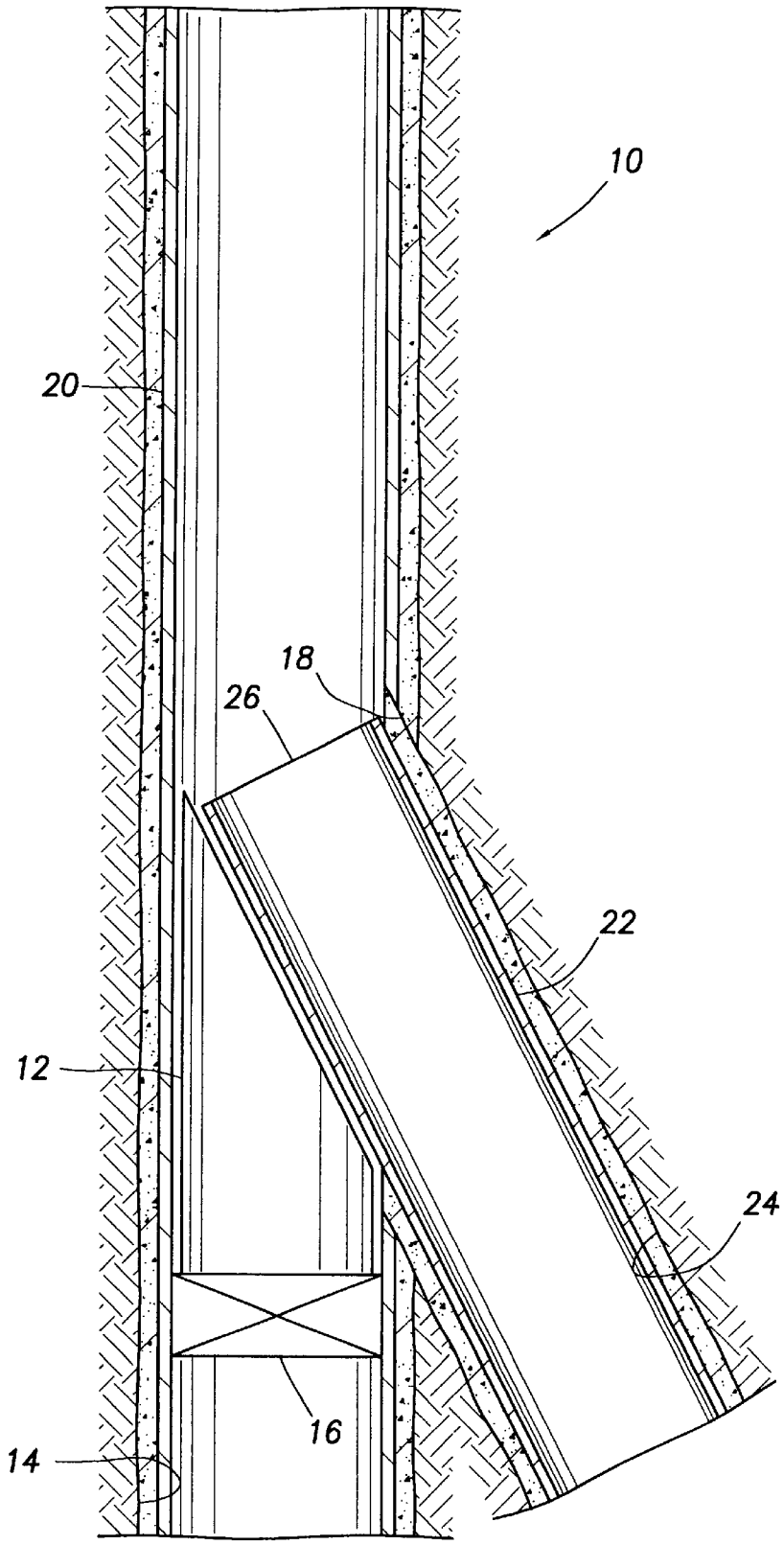
FIG. 1 is a schematic cross-sectional view of a method embodying principles of the present invention.

Representatively illustrated in FIG. 1 is a method 10 which embodies principles of the present invention. In the following description of the method 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

In the method 10 as depicted in FIG. 1, a whipstock 12 has been anchored in a parent or main wellbore 14 using an anchoring device 16, such as a packer. A window 18 has been milled through casing 20 lining the wellbore 14 by deflecting one or more cutting devices, such as mills, (not shown) off of the whipstock 12. A branch or lateral wellbore 24 has been formed extending outwardly from the window 18 by deflecting one or more other cutting devices, such as drill bits, (not shown) off of the whipstock 12. A liner 22 has been positioned in the lateral wellbore 24 by deflecting it off of the whipstock 12, and the liner is cemented within the lateral wellbore.

Note that an upper end 26 of the liner 22 remains in the parent wellbore 14, partially blocking the wellbore. Additionally, the whipstock 12 and packer 16 should be removed if access to the parent wellbore 14 below its intersection with the lateral wellbore 24 is desired. Preferably, the upper end 26 of the liner 22 extending through the window 18 would be cut off and the whipstock 12 would be retrieved in a single trip into the well. However, this method generally requires the use of a cutting device known to those skilled in the art as a washover tool (not shown in FIG. 1) having a relatively thin wall thickness, due to the small space radially between the whipstock 12 and the casing 20.

The thin walled washover tool is used to cut off the upper end 26 of the liner 22, to washover the whipstock 12, and to release the whipstock from the packer 16. Unfortunately, however, if the method 10 is performed from a floater, it may be very difficult to control the advancement of the washover tool in this operation. Thus, the washover tool may abruptly contact the upper end 26 of the liner 22, thereby damaging the tool, or, after cutting has commenced, it may be very difficult to maintain relatively uniform advancement of the washover tool. Furthermore, if a mud motor is used to drive the washover tool, and the motor stalls during the cutting operation, it may be very difficult to accurately disengage the washover tool from the structure being cut, and then to begin the cutting operation again. This situation makes it hazardous and inefficient to perform such cutting operations from a floater. Of course, similar situations may arise with land-based rigs (i.e., the need for accurate advancement of a downhole cutting device), and so it is to be clearly understood that the principles of the present invention are not limited to use in operations performed from a floater.

Figure 2:
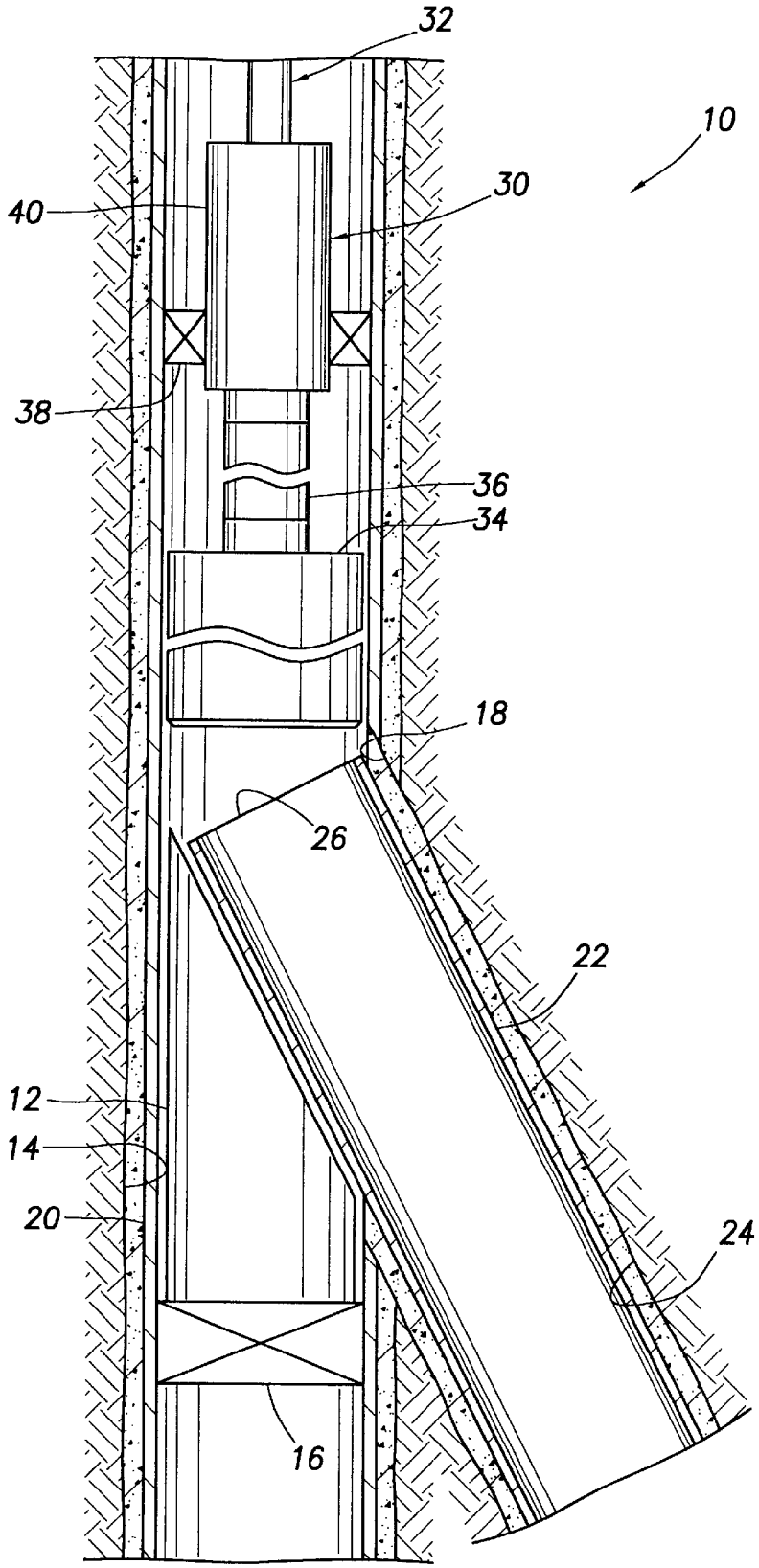
FIG. 2 is a schematic view of the method of FIG. 1, wherein further steps of the method are being performed.

Referring additionally now to FIG. 2, the method 10 is depicted in which additional steps have been performed. A motion compensator 30 embodying principles of the present invention has been interconnected in a tubular string 32, such as a drill string, above a cutting device 34, such as a washover tool. A downhole motor 36, such as a mud motor, which is operated by circulating fluid through the drill string 32, is interconnected between the motion compensator 30 and the washover tool 34. It is to be clearly understood that cutting devices other than the washover tool 34 and driving means other than the motor 36 may be utilized in methods and apparatus incorporating principles of the present invention.

The motion compensator 30 functions to isolate the washover tool 34 from the motion of the drill string 32 thereabove. Thus, if the drill string 32 at the surface is rising and falling, this rising and falling motion is not transmitted to the washover tool 34. This result is accomplished by including an anchoring device 38 and an advancement device 40 in the motion compensator 30.

The anchoring device 38 secures the motion compensator 30 in position in the wellbore 14, isolating the washover tool 34 from motion of the drill string 32 above the motion compensator, while the advancement device 40 displaces the washover tool 34 and motor 36 (and the remainder of the drill string 32 below the motion compensator) toward the structure to be cut. The advancement device 40 also includes a recocking or restroking feature which permits the washover tool 34 to be retracted out of engagement with the structure being cut (e.g., in the event that the motor 36 stalls), and then to be advanced again into contact with the structure.

Figure 3:
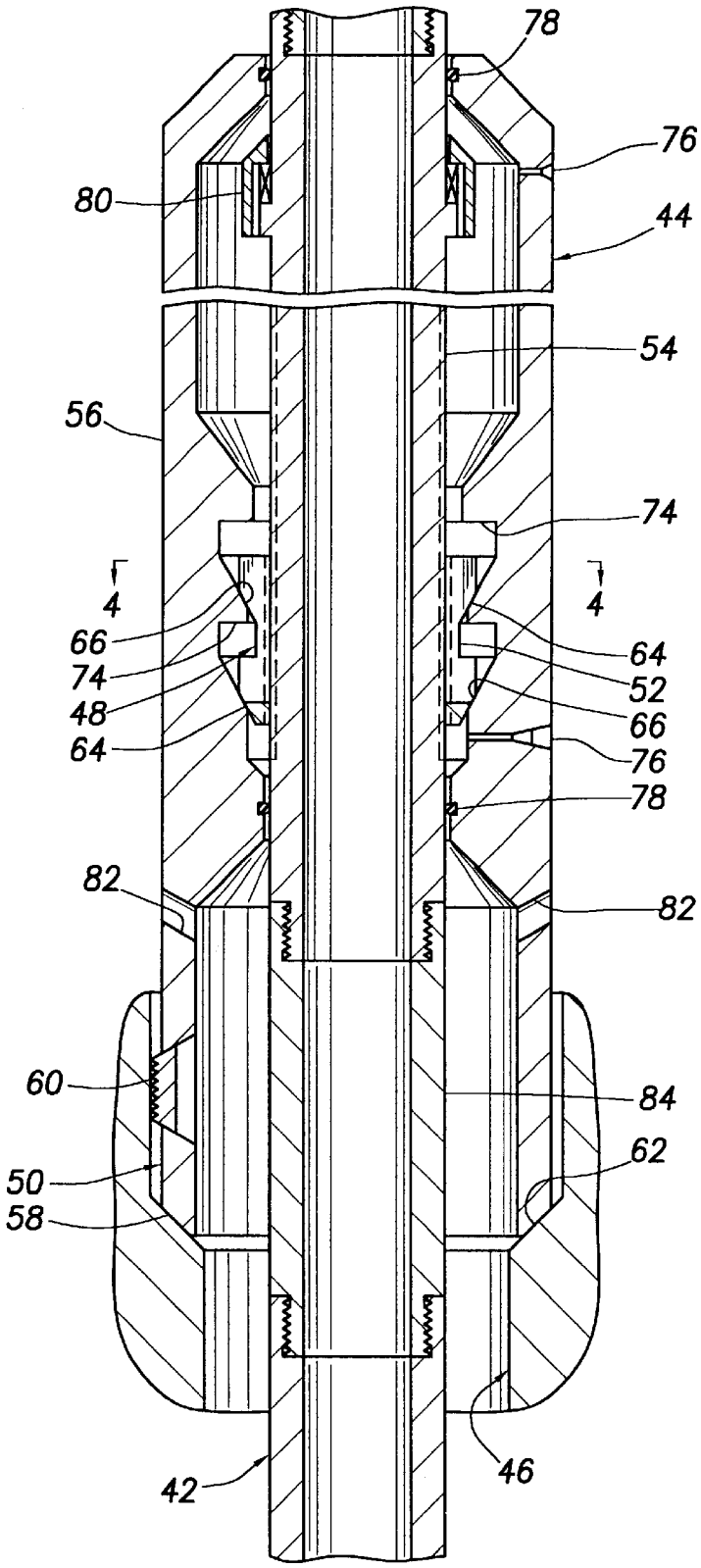
FIG. 3 is a schematic cross-sectional view of a motion compensator embodying principles of the present invention.

Referring additionally now to FIG. 3, a motion compensator 44 embodying principles of the present invention is representatively illustrated. The motion compensator 44 may be used for the motion compensator 30 in the method lo, or it may be used in other methods. In FIG. 3, the motion compensator 44 is depicted received within casing 46 and interconnected in a tubular string 42.

The motion compensator 44 includes an advancement device 48 and an anchoring device 50. The advancement device 48 includes an internally threaded radially expandable ring 52, an externally threaded inner mandrel 54 and an internal portion of an outer housing assembly 56 in which the ring is received. The anchoring device 50 includes a lower external shoulder 58 formed on the housing 56 and a gripping member 60, such as a slip.

The motion compensator 44 is positioned in a well by engaging the shoulder 58 with a corresponding appropriately dimensioned abutment member 62, such as an internal shoulder formed on the casing 46. At least a portion of the weight of the string 42 is placed on the motion compensator 44 by, for example, slacking off on the string at the surface. The string 42 is, thus, placed at least partially in compression above the motion compensator 44, thereby preventing any rising and falling motion of the string from being transmitted through the motion compensator.

The slip 60 is outwardly displaced from the housing 56 and grips the casing 46, thereby preventing rotation of the housing in the well. Of course, such slips, and methods of extending slips, are well known to those skilled in the art, and will not be described further herein. However, it is to be clearly understood that any manner of extending slips (e.g., hydraulic, mechanical, etc.), and any type of slip, may be used without departing from the principles of the present invention. Furthermore, slips may be used in the motion compensator 44 to axially, as well as rotationally, anchor the motion compensator 44 in the well, and with or without the additional use of engagement between the shoulders 58, 62.

As depicted in FIG. 3, weight of the string 42 has been placed on the motion compensator 44 and it has been anchored in position within the casing 46. The string 42 is attached to the mandrel 54 having the ring 52 threaded thereon, and the string's weight causes lower inclined shoulders 64 formed externally on the ring to engage inclined shoulders 66 formed internally in the housing 56. This engagement between the shoulders 64, 66 radially inwardly biases the ring 52, maintaining the threaded engagement between the ring and the mandrel 54.

Figure 4:
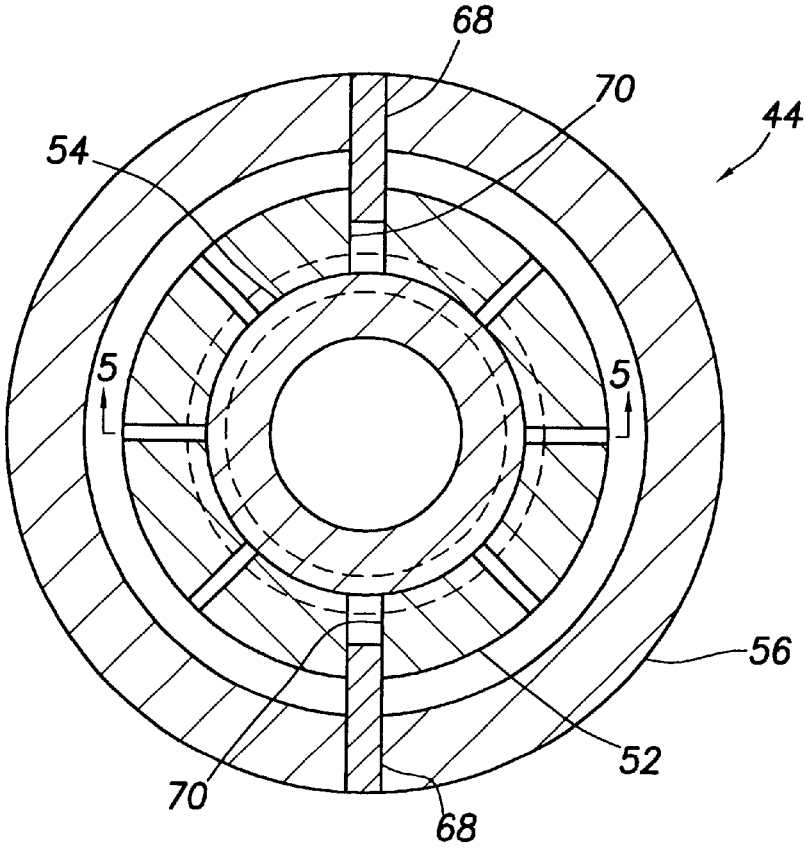
FIG. 4 is a cross-sectional view of a portion of the motion compensator of FIG. 3, taken along line 4—4.

Referring additionally now to FIG. 4, a cross-sectional view of the motion compensator 44, taken along line 4—4 of FIG. 3, is representatively illustrated, showing the engagement between the housing 56, the ring 52 and the mandrel 54. Note that pins 68 extend through the housing 56 and into axial slots 70 formed through the ring 52. The ring 52 is, thus, prevented from rotating relative to the housing 56.

Figure 5:
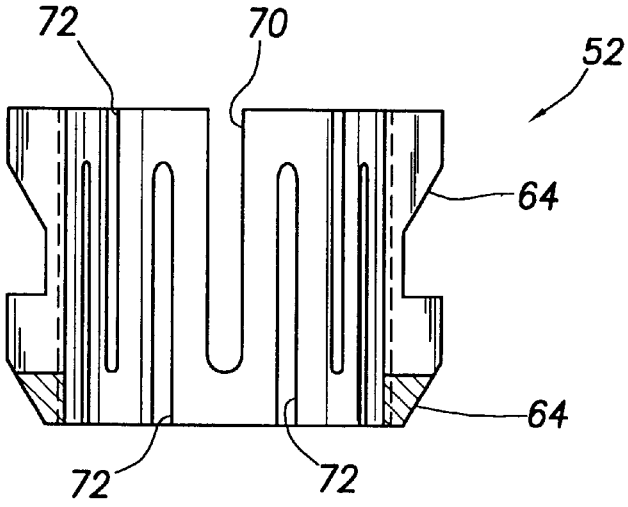
FIG. 5 is a cross-sectional view of a ratcheting member of the motion compensator of FIG. 3, taken along line 5—5 of FIG. 4.
Figure 6A:
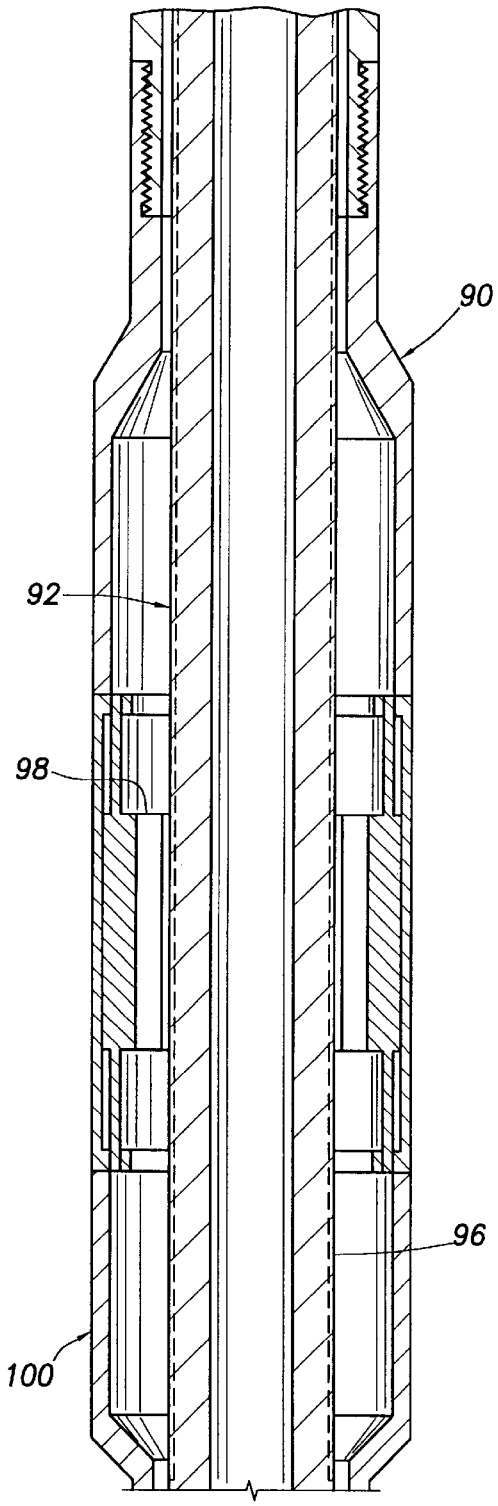
FIGS. 6A–F are cross-sectional views of successive axial portions of a second motion compensator embodying principles of the present invention.
Figure 6B:
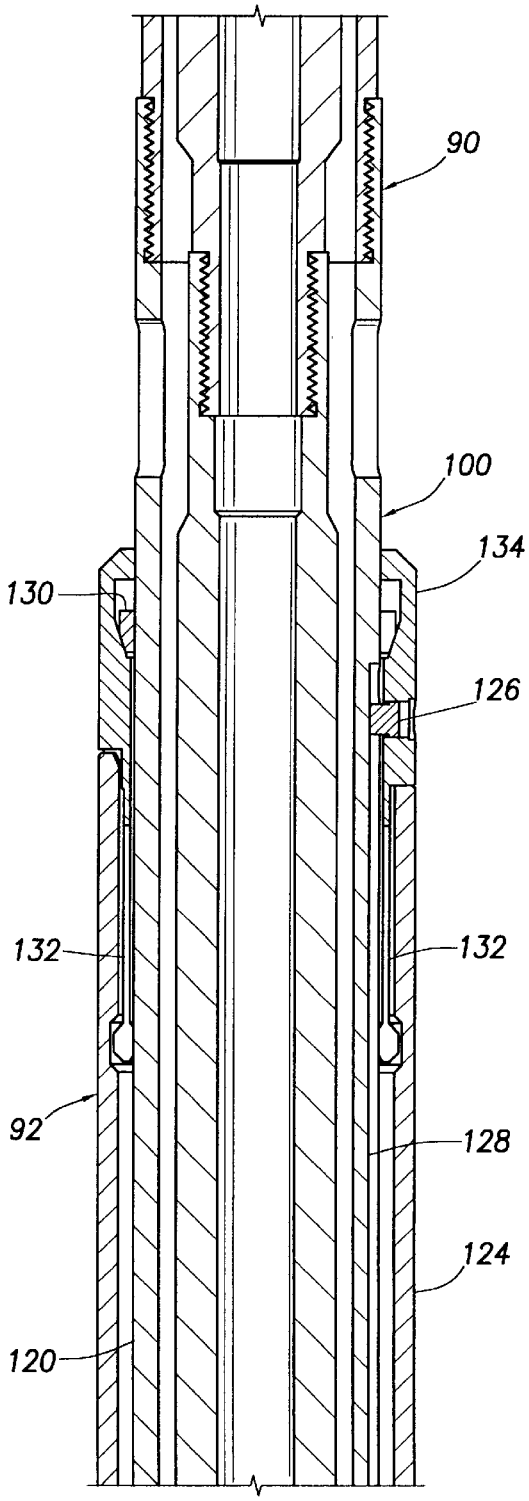
Figure 6C:
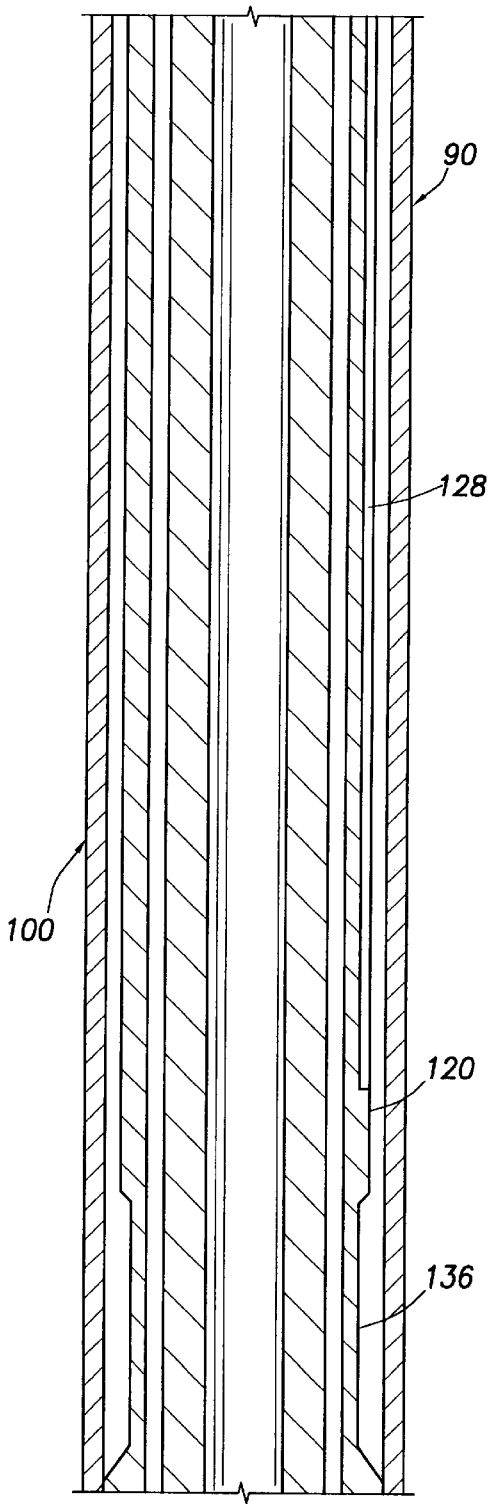
Figure 6D:
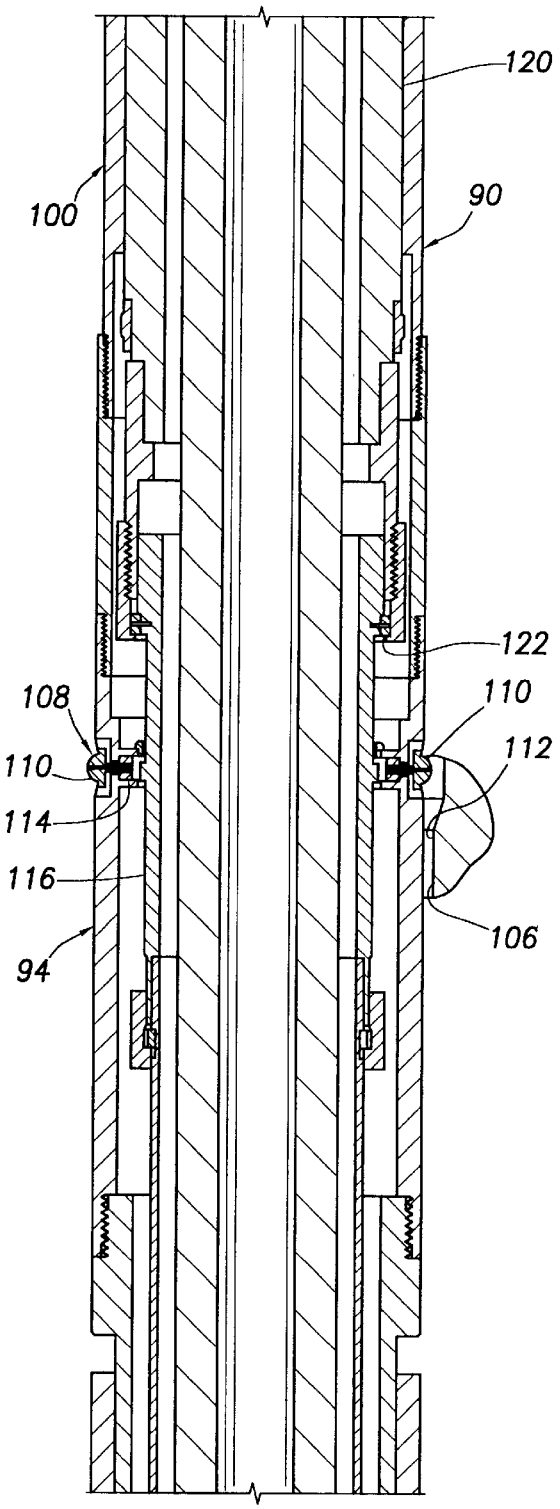
Figure 6E:
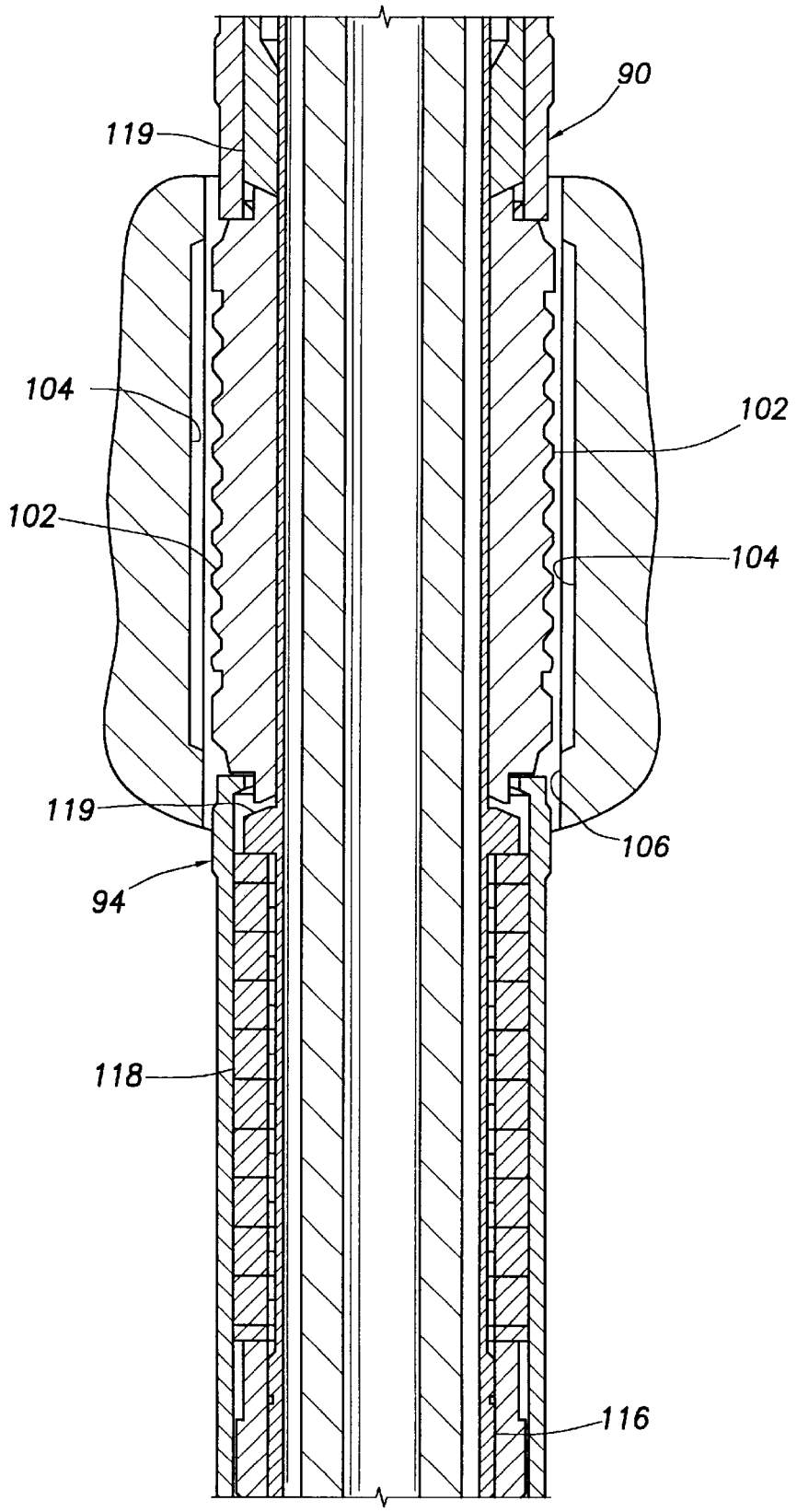
Figure 6F:
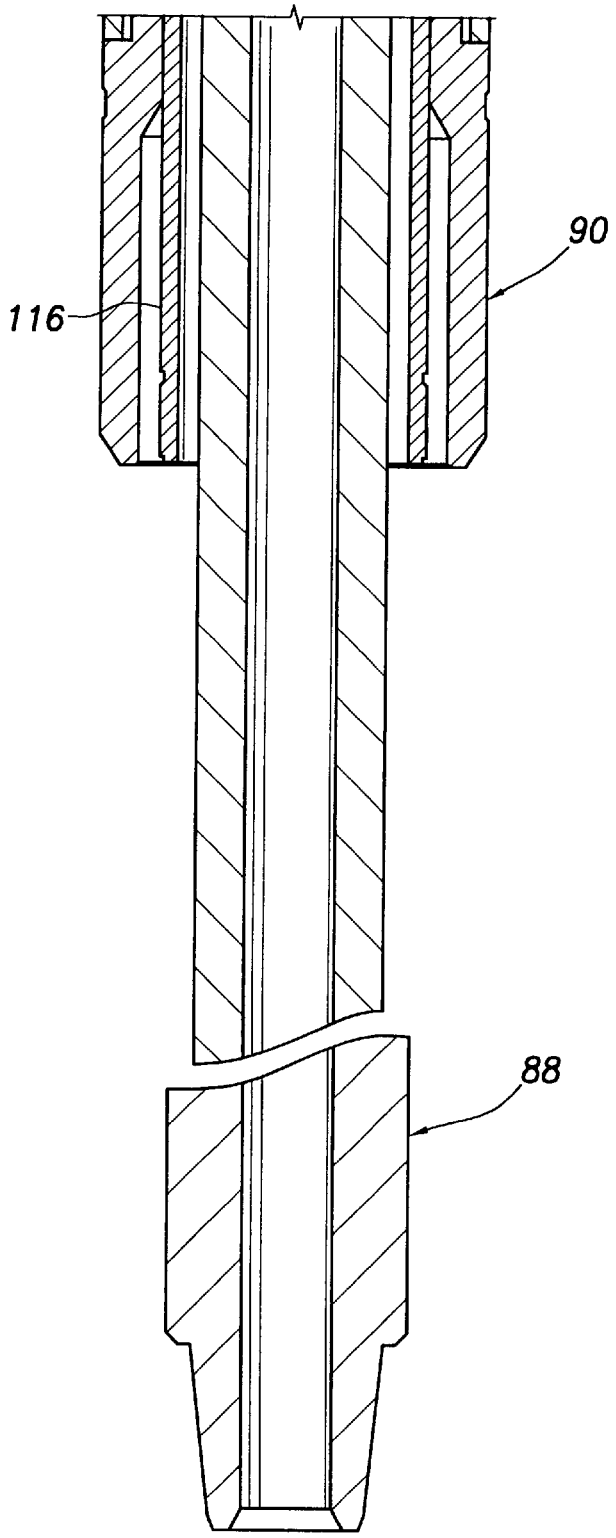

Referring additionally now to FIG. 5, a cross-sectional view of the ring 52, taken along line 5—5 of FIG. 4, is representatively illustrated. In this view it may be seen that the ring 52 has additional axial slots 72 formed partially axially through the ring, alternating from either end of the ring. The slots 70, 72 enable the ring 52 to radially deform somewhat.

It will be readily appreciated that, if the string 42 is rotated, the mandrel 54 will rotate as well, and the threaded engagement between the mandrel and the ring 52 will cause the mandrel to correspondingly displace axially. For example, using a right-handed thread, rotation of the string 42 clockwise from the surface will cause the mandrel 54 to be displaced downwardly. It will also be readily appreciated that such rotation of the string 42 may be easily controlled from the surface, whether or not the string is also rising and falling, and that such rotation produces a known accurate axial displacement of the mandrel 54. Thus, with the washover tool 34 attached to the string 42 below the motion compensator 44, as in the method 10, the washover tool may be accurately and controllably advanced relative to the motion compensator by merely rotating the string.

In the event that a problem is experienced in the cutting operation, the mandrel 54 may be conveniently displaced axially upwardly to thereby disengage the cutting device from the structure being cut. Specifically, the string 42 is raised, relieving the weight of the string from the motion compensator 44, and eventually raising the mandrel 54. As the mandrel 54 begins to raise relative to the housing 56, the shoulders 64, 66 disengage and the ring 52 is raised along with the mandrel. However, the ring 52 eventually contacts shoulders 74 formed in the housing 56, preventing further upward displacement of the ring relative to the housing. Nevertheless, the mandrel 54 continues to raise relative to the housing 56, due to the fact that the ring 52 is radially expandable and is able to ratchet over the external threads on the mandrel. Preferably, this ratcheting action is enhanced by forming the threads on the ring 52 and mandrel 54 as buttress-type threads, which also provides advantageous contact between the threads when weight is applied to the mandrel 54 during the cutting operation.

When the mandrel 54 has been raised relative to the housing 56 a sufficient distance to disengage the cutting device from the structure being cut, weight of the string 42 may again be applied to the motion compensator 44, for example, by slacking off on the string at the surface. This weight applied to the motion compensator 44 causes the shoulders 64, 66 to engage again, maintaining the ring 52 in threaded engagement with the mandrel 54 at a position lower on the mandrel than prior to the string 42 being raised. The string 42 may then be rotated to again advance the cuffing device axially relative to the motion compensator 44.

Additional features of the motion compensator 44 include ports 76 and wiper rings 78 for packing the interior of the housing 56 with lubricant, such as grease, and a swivel 80 limiting upward displacement of the mandrel 54 relative to the housing 56 while permitting rotation of the mandrel relative to the housing. Circulation openings 82 are provided in the housing 56. Spacers 84 may be provided in the string 42 as needed to appropriately space apart the cutting device from the motion compensator 44.

Referring additionally now to FIGS. 6A–F, another motion compensator 90 embodying principles of the present invention is representatively illustrated. The motion compensator 90 is depicted interconnected in a tubular string 88 and received within casing 106 in a well. The motion compensator 90 is similar in many respects to the motion compensator 44 described above, and it may be used for the motion compensator 30 in the method 10. However, it is to be clearly understood that the motion compensator 90 may be differently configured and may be used in other methods, without departing from the principles of the present invention.

The motion compensator 90 includes an advancement device 92 and an anchoring device 94. The advancement device 92 includes an externally threaded inner mandrel 96 threadedly engaged with a conventional roller screw nut 98 attached to an outer housing assembly 100 of the motion compensator 90. A suitable roller screw nut is available from SKF, Inc. as model no. SRC. Of course, other types of nuts or other internally threaded members may be utilized in place of the nut 98.

The anchoring device 94 includes lugs or key members 102 which are outwardly extendable for engagement with cooperatively shaped recesses or pockets 104 formed internally in casing 106 in the well. It will be readily appreciated that, when the keys 102 are engaged in the recesses 104, the motion compensator 90 is rotationally and axially anchored relative to the casing 106.

The keys 102 are extended outwardly when a bore sensing mechanism 108 senses a change in diameter in the casing 106. Specifically, when a series of buttons 110 are displaced inwardly by a predetermined diameter 112 in the casing 106, a retaining ring 114 securing an inner sleeve 116 in a downwardly disposed position is released, thereby permitting the sleeve to be displaced upwardly by the biasing force exerted by a compressed spring 118. The spring 118 may then expand, forcing the keys 102 to be outwardly extended by opposing wedge members 119.

The sleeve 116 is connected to an inner housing extension 120 of the housing assembly 100 by means of an expanded C-ring 122. Upward displacement of the sleeve 116 permits the C-ring 122 to inwardly retract out of engagement with the inner extension 120, thereby permitting the inner extension to displace upwardly. Since the inner extension 120 is telescopingly received within an outer housing extension 124 of the housing assembly 100, upward displacement of the extension 120 causes elongation of the housing assembly. A pin 126 is received in an axial slot 128 formed externally on the inner extension 120 to prevent relative rotation between the inner and outer extensions 120, 124. Therefore, the bore sensing mechanism 108 both releases the keys 102 for engagement with the recesses 104, and releases the inner extension 120 for axial displacement relative to the outer extension 124.

An internal slip 130 prevents compression of the housing assembly 100 after the inner extension 120 has displaced upwardly relative to the outer extension 124. The inner extension 120 is displaced upwardly relative to the outer extension 124 when it is desired to disengage the cutting device from the structure being cut. For example, if the motion compensator 90 is used for the motion compensator 30 in the method 10 and the motor 36 stalls during a cutting operation, then the housing assembly 100 may be lengthened to raise the advancement device 92 and disengage the cutting device 34 from the structure being cut. Stated differently, elongating the housing assembly 100 above the anchoring device 94 effectively shortens the tubular string 32 below the motion compensator 90, thereby raising the cutting device 34 relative to the structure being cut.

When it is desired to resume the cutting operation, the mandrel 96 is again rotated by rotating the tubular string at the surface. Preferably, during the cutting operation, weight of the tubular string is applied to the motion compensator 90 by slacking off on the tubular string at the surface. The slip 130 prevents this weight from compressing the housing assembly 100 after it has been elongated.

After the cutting operation is completed, the inner extension 120 may be raised relative to the outer extension 124 by picking up on the tubular string at the surface, until collets 132 securing an end cap 134 to the outer extension are permitted to retract into a recess 136 formed externally on the inner extension. Radially inward displacement of the collets 132 permits the outer extension 124 to displace downwardly relative to the inner extension 120. An upward pull on the tubular string from the surface of a sufficient force will cause the keys 102 to retract out of engagement with the recesses 104, permitting the motion compensator 90 to be retrieved from the well.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. A method of controlling displacement of a cutting device conveyed on a tubular string in a subterranean well, the method comprising the steps of:

interconnecting a motion compensator in the tubular string above the cutting device, the motion compensator including an axial advancement device and an anchoring device;

operating the cutting device to cut a structure within the well;

actuating the anchoring device to anchor the motion compensator in the well during the cutting device operating step; and actuating the advancement device to control displacement of the cutting device relative to the motion compensator during the cutting device operating step.

2. The method according to claim 1, wherein the anchoring device actuating step further comprises extending a gripping member outwardly from the motion compensator.

3. The method according to claim 1, wherein the anchoring device actuating step further comprises engaging the motion compensator with an abutment within the well.

4. The method according to claim 1, wherein the anchoring device actuating step further comprises extending a key member outwardly from the motion compensator.

5. The method according to claim 1, wherein the anchoring device actuating step further comprises preventing rotation of an outer housing of the motion compensator.

6. The method according to claim 5, wherein the preventing rotation step further comprises outwardly extending a gripping member.

7. The method according to claim 5, wherein the preventing rotation step further comprises outwardly extending a key member.

8. The method according to claim 1, wherein the motion compensator interconnecting step further comprises interconnecting the motion compensator in the tubular string above a downhole motor.

9. The method according to claim 8, wherein the cutting device operating step further comprises circulating fluid through the tubular string to thereby operate the downhole motor.

10. The method according to claim 1, wherein the advancement device actuating step further comprises axially extending the tubular string between the motion compensator and the cutting device while the motion compensator remains anchored in the well.

11. The method according to claim 10, wherein the advancement device actuating step further comprises axially shortening the tubular string between the motion compensator and the cutting device while the motion compensator remains anchored in the well.

12. The method according to claim 11, wherein the axially shortening step is performed after the axially extending step.

13. The method according to claim 11, wherein the axially shortening step further comprises ratcheting a first member of the motion compensator relative to a second member of the motion compensator.

14. The method according to claim 13, wherein in the ratcheting step, the first member is axially secured relative to the anchoring device and the second member is axially secured relative to the tubular string.

15. The method according to claim 1, wherein the advancement device actuating step further comprises axially extending the motion compensator to thereby increase a distance between the anchoring device and the tubular string above the motion compensator.

16. The method according to claim 15, wherein the motion compensator extending step further comprises elongating a telescoping portion of the motion compensator.

17. The method according to claim 15, wherein the motion compensator extending step further comprises elongating an outer housing of the motion compensator.

18. The method according to claim 1, wherein the anchoring device actuating step is performed in response to the motion compensator sensing a change in diameter in the well.

19. The method according to claim 18, wherein the anchoring device actuating step further comprises outwardly extending a member from the motion compensator in response to the motion compensator sensing the change in diameter in the well.

20. A system for compensating for motion in a cutting operation in a subterranean well, the apparatus comprising:

a cutting device interconnected at a lower end of a tubular string; and a motion compensator interconnected in the tubular string above the cutting device, the motion compensator including an anchoring device operative to anchor the motion compensator in the well, and an advancement device operative to control axial displacement of the cutting device relative to the motion compensator.

21. The system according to claim 20, wherein the motion compensator further includes a diameter sensing device operative to actuate the anchoring device in response to sensing a predetermined diameter in the well.

22. The system according to claim 21, wherein a member of the anchoring device is outwardly extended from the motion compensator when the sensing device senses the predetermined diameter.

23. The system according to claim 20, wherein the advancement device axially extends the motion compensator, thereby increasing a distance between the anchoring device and the tubular string above the motion compensator.

24. The system according to claim 23, wherein the advancement device comprises a telescoping portion of the motion compensator, the telescoping portion being connected between the anchoring device and the tubular string above the motion compensator.

25. The system according to claim 23, wherein the advancement device comprises an axially elongatable outer housing of the motion compensator.

26. The system according to claim 20, wherein the advancement device is configured to axially extend the tubular string between the motion compensator and the cutting device.

27. The system according to claim 26, wherein the advancement device is further configured to axially shorten the tubular string between the motion compensator and the cutting device.

28. The system according to claim 27, wherein the advancement device includes ratcheting first and second members.

29. The system according to claim 28, wherein the first member is axially secured relative to the anchoring device and the second member is axially secured relative to the tubular string.

30. The system according to claim 20, further comprising a downhole motor interconnected in the tubular string between the motion compensator and the cutting device.

31. The system according to claim 30, wherein the downhole motor is operable in response to circulation of fluid through the tubular string.

32. The system according to claim 20, wherein the anchoring device prevents rotation of an outer housing of the motion compensator.

33. The system according to claim 32, wherein the anchoring device prevents rotation of the outer housing by extending a gripping member outwardly therefrom.

34. The system according to claim 32, wherein the anchoring device prevents rotation of the outer housing by extending a key member outwardly therefrom.

35. The system according to claim 20, wherein the anchoring device includes an outwardly extendable member.

36. The system according to claim 35, wherein the outwardly extendable member is a gripping member.

37. The system according to claim 35, wherein the outwardly extendable member is a key member.

38. The system according to claim 20, wherein the anchoring device includes a shoulder engageable with an abutment in the well.

* * * * *